US010399046B1

(12) United States Patent
Smith

(10) Patent No.: US 10,399,046 B1
(45) Date of Patent: Sep. 3, 2019

(54) STEAM INJECTION AND MIXING DEVICE

(71) Applicant: Komax Systems, Inc., Huntington Beach, CA (US)

(72) Inventor: Robert Smith, Seal Beach, CA (US)

(73) Assignee: Komax, Inc., Huntington Beach, CA (US)

( * ) Notice: Subject to any disclaimer, the term of this patent is extended or adjusted under 35 U.S.C. 154(b) by 251 days.

(21) Appl. No.: 15/667,838

(22) Filed: Aug. 3, 2017

(51) Int. Cl.
*B01F 5/04* (2006.01)
*B01F 5/00* (2006.01)
*B01F 5/06* (2006.01)

(52) U.S. Cl.
CPC ..... *B01F 5/0475* (2013.01); *B01F 5/0473* (2013.01); *B01F 5/0068* (2013.01); *B01F 2005/0634* (2013.01)

(58) Field of Classification Search
CPC .... B01F 5/0068; B01F 5/0473; B01F 5/0475; B01F 2005/0634
USPC ..... 261/76, DIG. 10
See application file for complete search history.

(56) References Cited

U.S. PATENT DOCUMENTS 1,218,470 A * 3/1917 Rider ..... C01B 3/36 123/550
1,616,209 A * 2/1927 Weisgerber ..... B01D 11/0473 159/16.3
3,450,800 A * 6/1969 Smith et al. ..... B01F 3/0446 261/118
3,936,382 A * 2/1976 White ..... B01F 5/0453 210/198.1
4,824,614 A * 4/1989 Jones ..... B01F 5/0617 137/561 A
4,900,481 A * 2/1990 Kishioka ..... A61L 2/202 261/64.4
5,176,448 A 1/1993 King et al.
5,605,399 A 2/1997 King
6,076,809 A 6/2000 Cummins et al.
6,082,712 A * 7/2000 Cincotta ..... B01F 5/0416 261/76
8,721,840 B2 * 5/2014 Peltonen ..... B01F 5/0451 162/232
2012/0014209 A1 1/2012 Smith
(Continued)

*Primary Examiner* — Charles S Bushey
(74) *Attorney, Agent, or Firm* — Bay Area Technology Law Group PC

(57) ABSTRACT

A device for the injection and mixing of steam into a fluid stream. The device includes a cylindrically-shaped primary conduit having a longitudinal axis and circular cross-section for carrying the fluid stream. The primary conduit is provided with an inlet for accepting the fluid stream and an outlet for discharging the fluid stream along the longitudinal axis. A secondary conduit is joined to the primary conduit for discharging steam within the fluid stream along the longitudinal axis. A biscuit element is provided having upstream and downstream circular faces of diameters approximately that of the primary conduit's interior wall and having a geometric center coincident with the longitudinal axis and further having a plurality of openings through the biscuit each having a longitudinal axis substantially parallel to the longitudinal axis of the primary conduit and each of the openings having located therein a plurality of microtubes such that steam passing through the secondary conduit and fluid passing through the primary conduit pass through the microtubes and are mixed thereby.

11 Claims, 2 Drawing Sheets

(56) References Cited

U.S. PATENT DOCUMENTS

| | | | | |
|---|---|---|---|---|
| 2013/0174924 | A1 | 7/2013 | Luo et al. | |
| 2013/0241089 | A1 * | 9/2013 | Westmoreland ..... | F23R 3/286<br>261/76 |

* cited by examiner

STEAM INJECTION AND MIXING DEVICE

TECHNICAL FIELD

The present invention is directed to a highly efficient steam injector, that is, a steam injection heater for heating liquids moving within a conduit. For example, waste effluent from mining operations including mining tailings are processed in order to remove solvent from aqueous carrier liquid. Separation of this effluent stream into its component parts is facilitated by heating. An excellent way to do so is through the use of a steam injector device such as that of the present invention.

BACKGROUND OF THE INVENTION

Steam injection has been a unit operation carried out by chemical engineers in processing facilities for as long as chemical engineering has been a science. For example, a typical steam injection water heater was disclosed in U.S. Pat. No. 2,455,498. Subsequently, U.S. Pat. No. 3,984,504 dealt with the fabrication of a rather complex device used to eliminate water hammer which has characterized steam injection systems in the past. It was recognized that such heaters worked satisfactorily at relatively low steam pressure such as at pressures below 300 psi. At high steam pressures, however, water hammer develops due to the sudden collapse of relatively large steam bubbles which are created at high pressures as it condenses within the water.

Steam injection has also been viewed as a preferred expedient in the heat transfer from a first fluid to a moving steam of a liquid commonly employed in food processing. Liquid food products often times must be heated for sterilization and other purposes in an environment which maintains the integrity of the food product free of contamination from the heat source.

Direct steam injection has long been recognized as an exceedingly efficient technique for heating liquids. As steam is injected directly into a liquid, one can realize almost 100 percent of the BTU's in the steam which are absorbed directly into the liquid. Unlike indirect heating by means of, for example, a heat exchanger, there is no condensate retaining unused sensible heat. Because of this high heat-transferability, direct steam injection can save a great deal in energy costs.

Direct steam injection systems offer other benefits as well when compared to heat exchangers and comparable indirect heating systems. A direct steam injection system can provide very accurate temperature control within several degrees Fahrenheit and are efficient in that scale buildup does not become an issue. Systems of this nature also tend to be more compact then comparable heat exchange devices.

There are four basic types of direct steam injection systems, namely, the sparger, the mixing tee, the Venturi and the modulating injection system. The sparger is the simplest system in that it generally consists of nothing more than a perforated pipe discharging steam in a vented storage tank. However, these systems are not without their disadvantages. For example, they must be operated at a set and constant flow rate to prevent the hammering effect observed in steam/water systems. This is the result of operating at steam and water pressures which are at or near equilibrium.

Mixings tees comprise nothing more than steam and waterlines which join a common conduit. Because separate lines are used for each fluid, capital equipment tends to be expensive and inconvenient to install.

Venturi systems are generally more acceptable than those previously discussed, but should be operated under conditions of constant steam pressure, inlet water pressure and outflow demand. If they do not, hammering effect can again be observed as the steam and inlet water pressures approach an equilibrium condition. In addition, changes in these variables can result in varying outlet temperatures which may not be desired.

Prior attempts have even been made to employ static mixers for direct steam injection into a fluid stream. However, as in the other prior approaches, the results have proven spotty with instability and lack of control problems being manifest.

The creation of vibration is a well recognized problem when dealing with direct steam injection. As a consequence, it has been determined that a preferable mixing device would be one capable of reducing vibration in the feed pipes where the mixing takes place. Also, steam injection through static mixing having applicability in mining operations and the like can cause erosion of critical elements. Although static mixing elements, by their very definition, have no moving parts and are thus relatively inexpensive to install and service, when servicing is required, the cost and inconvenience of doing so can be significant as processing lines must be shut down or diverted and various pipelines disconnected in order to gain access to their interiors.

It is thus an object of the present invention to provide a static mixing element in the form of a modular injection system for the introduction of steam to a fluid which minimizes vibration while doing so.

It is yet a further object of the present invention to provide a static mixing element which is more erosion resistant than similar devices of the prior art and when erosion does occur, parts which are worn can be relatively easily replaced.

These and further objects will be more readily apparent when considering the following disclosure and appended claims.

SUMMARY OF THE INVENTION

A device for the injection and mixing of steam into a fluid stream. The device includes a cylindrically-shaped primary conduit having a longitudinal axis and circular cross-section for carrying the fluid stream. The primary conduit is provided with an inlet for accepting the fluid stream and an outlet for discharging the fluid stream along the longitudinal axis. A secondary conduit is joined to the primary conduit for discharging steam within the fluid stream along the longitudinal axis. A biscuit element is provided having upstream and downstream circular faces of diameters approximately that of the primary conduit's interior wall and having a geometric center coincident with the longitudinal axis and further having a plurality of openings through the biscuit each having a longitudinal axis substantially parallel to the longitudinal axis of the primary conduit and each of the openings having located therein a plurality of microtubes such that steam passing through the secondary conduit and fluid passing through the primary conduit pass through the microtubes and are mixed thereby.

DETAILED DESCRIPTION OF THE INVENTION

Figure 1:
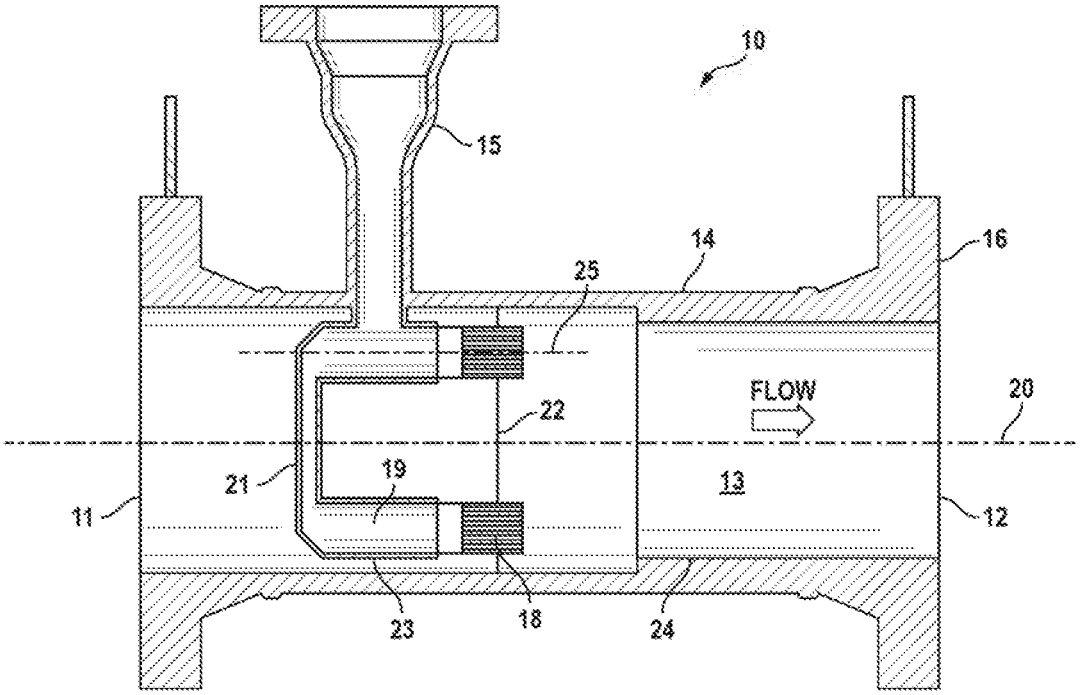
FIG. 1 is a cross-sectional view depicting a first embodiment of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Turning first to FIG. 1, device 10 of the present invention is shown for the injection and mixing of steam into a fluid stream. The device comprises substantially cylindrically-shaped primary conduit 14 receiving the fluid stream (not shown) at its upstream end 11. Cylindrically-shaped primary conduit 14 has a substantially circular cross-section (FIG. 2) and longitudinal axis 20 designed for carrying the fluid stream. As depicted in FIG. 1, primary conduit 14 has an inlet end 11 for accepting the fluid stream and outlet 12 for passing the fluid stream which has received steam from secondary conduit 15. Cylindrically-shaped primary conduit 14 terminates at flange 16.

Figure 3:
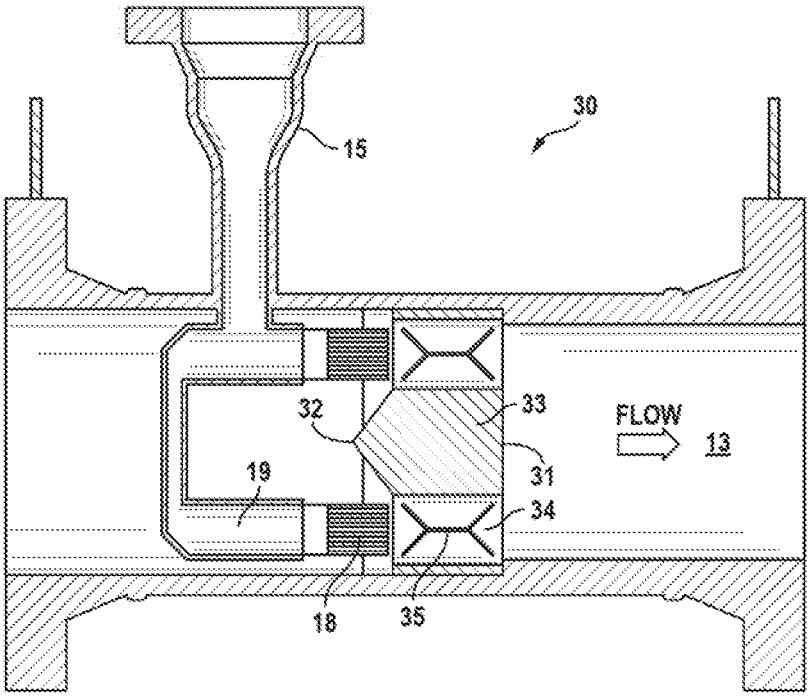
FIG. 3 is a cross-sectional view of a second embodiment of the present invention.

Secondary conduit 15 is joined to primary conduit 14 preferably by passing through its side wall as shown in FIGS. 1 and 3. Secondary conduit 15 passes perpendicularly through the side wall of primary conduit 14 injecting steam directly within biscuit element 19 upstream of plurality of openings 17.

Figure 2:
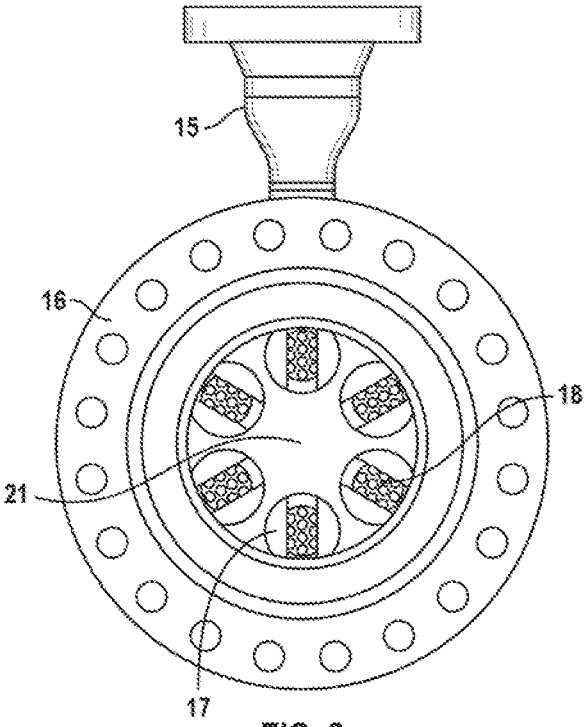
FIG. 2 is an end view of the invention depicted in FIG. 1.

In summary, device 10 intended for the injection and mixing of steam into fluid stream 13 comprising substantially cylindrically-shaped primary conduit 14 having longitudinal axis 20 and a substantially circular cross-section best seen by viewing FIG. 2. Primary conduit 14 is provided with an inlet 11 for accepting fluid stream 13 and an outlet 12 for discharging fluid stream 13 along longitudinal axis 20. A secondary conduit 15 is provided joined to primary conduit 14 for discharging steam within fluid stream 13 along longitudinal axis 20. A biscuit element 19 having upstream and downstream circular faces 21 and 22, respectively, and a diameter approximately that of the inner wall of primary conduit 14 is positioned such that outer edge 23 of biscuit element 19 fits somewhat snugly against interior wall 24 of primary conduit 14 having a geometric center coincident with longitudinal axis 20 as shown.

Biscuit element 19 is provided with a plurality of openings 17 each having a longitudinal axis 25 substantially parallel to longitudinal axis 20 of primary conduit 14 and each having located therein, a plurality of microtubes 18 such that steam passing through secondary conduit 15 pass through microtubes 18 and are mixed thereby.

Each of microtubes 18 have a circular cross-section and longitudinal axis substantially parallel to longitudinal axis 20 of primary conduit 14. An aspect of the present invention is to provide microtubes which are removable from said plurality of openings 17 for cleaning and replacement.

As best shown by reference to FIG. 2, biscuit 19 is provided, ideally, with six openings equally spaced about longitudinal axis 20. Steam passing from secondary conduit 15 together with fluid entering upstream end 11 of primary conduit 14 mix within openings 17 by passing through microtubes 18. Microtubes 18 cause biscuit openings 17 to be tuned to enhance mixing and to reduce vibration in conduits 14 and 15. The use of microtubes 18 also improve wear performance as erosion is reduced by distributing potentially destructive steam across all six biscuit openings. This would allow the use of less exotic materials than were necessary in the past thus reducing costs and improving delivery times.

To size the microtubes, one would begin by noting the actual volume of steam and calculate the internal fluid pressure within the conduit. Once knowing the actual volume, one could calculate the area of combined microtubes to deliver steam at a preferred velocity range of 250 to 1,000 feet per second. Targeting approximately 25 percent of the open area representing the internal area of the microtubes, the number of tubes would be determined assuming a typical tube inside diameter of approximately 0.375 inches.

To further enhance mixing, and as an optional preferred embodiment, supplemental mixing element 31 is provided located downstream of plurality of openings 17. Supplemental mixing element 31 is placed within primary conduit 14 downstream of biscuit element 19.

Supplemental mixing element 31 is configured with a plurality of openings 34. In an ideal configuration, a hexagonal array of six such openings 34 would be provided equidistant from longitudinal axis 20.

It is intended that each opening 34 be fitted with a mixing element 35 which induces the same rotational sign to fluids passing therethrough in order to maximize mixing. Ideally, these mixing elements can be those disclosed in the present assignee's prior U.S. Pat. No. 3,923,288, the disclosure of which is incorporated by reference. Such mixing elements include an essential flat rectangular portion, the plane of which is intended to generally align with the fluid inlet along its longitudinal axis which substantially parallels longitudinal axis 20 of primary conduit 14. First and second ears emanate from the centrally located flat portion and are rounded or otherwise configured at their outside peripheries for a general fit to the side walls of the openings in which they are placed. As noted in the '288 patent, these mixing elements can be formed from a single flat sheet by a punch press, for example. However, the present invention is not intended to be limited to any particular fabrication nor is the invention limited to providing those elements of the '288 patent as other mixing elements which perform the same function can be employed.

In order to optimize the fluid dynamics of mixing, conically-shaped feature 33 is applied to the upstream face of supplemental mixing element 31. Ideally, conically-shaped feature 33 is removably attached to supplemental mixing element 31, apex 32 of which is located upstream of chambers 34 as shown in FIG. 3.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A device for the injection and mixing of steam into a fluid stream, said device comprising:

a substantially cylindrically-shaped primary conduit having a longitudinal axis and a substantially circular cross-section for carrying said fluid stream, said primary conduit being provided with an inlet for accepting said fluid stream and an outlet for discharging said fluid stream along said longitudinal axis;

a secondary conduit joined to said primary conduit for discharging steam within said fluid stream along said longitudinal axis;

a biscuit element having upstream and downstream circular faces of diameters approximately that of said primary conduit's interior wall and having a geometric center coincident with said longitudinal axis and having a plurality of openings through said biscuit each having a longitudinal axis substantially parallel to the longitudinal axis of said primary conduit; and each of said openings having located therein a plurality of microtubes such that steam passing through said secondary conduit and fluid passing through said primary conduit pass through said microtubes and are mixed thereby.

2. The device of claim 1 wherein said microtubes each have a circular cross-section and longitudinal axis substantially parallel to the longitudinal axis of said primary conduit.

3. The device of claim 1 wherein said microtubes are removable from said plurality of openings for cleaning and replacement.

4. The device of claim 1 wherein said microtubes are characterized as having internal diameters of approximately 0.375 inches.

5. The device of claim 1 wherein said plurality of microtubes within said plurality of openings constitute an open area of approximately 25 percent of said primary conduit.

6. The device of claim 1 wherein said secondary conduit passes through said side wall of said primary conduit approximately perpendicular thereto and upstream of said plurality of openings.

7. The device of claim 1 further comprising a supplemental mixing element located downstream of said plurality of openings.

8. The device of claim 7 wherein said supplemental mixing element comprises a plurality of chambers and within said chambers are located mixing elements which induce a rotational angular velocity to said fluid stream.

9. The device of claim 8 wherein said supplemental mixing element possesses a conically-shaped protrusion whose apex is located upstream of said plurality of chambers.

10. The device of claim 9 wherein said apex is positioned approximately at said longitudinal axis and said chambers are each positioned equidistant therefrom.

11. A method of injecting and mixing steam into a fluid stream comprising providing:

a substantially cylindrically-shaped primary conduit having a longitudinal axis and a substantially circular cross-section for carrying said fluid stream, said primary conduit being provided with an inlet for accepting said fluid stream and an outlet for discharging said fluid stream along said longitudinal axis;

a secondary conduit joined to said primary conduit for discharging steam within said fluid stream along said longitudinal axis;

a biscuit element having upstream and downstream circular faces of diameters approximately that of said primary conduit's interior wall and having a geometric center coincident with said longitudinal axis and having a plurality of openings through said biscuit each having a longitudinal axis substantially parallel to the longitudinal axis of said primary conduit;

each of said openings having located therein a plurality of microtubes such that steam passing through said secondary conduit and fluid passing through said primary conduit pass through said microtubes and are mixed thereby; and introducing said fluid stream at an upstream end of said primary conduit and introducing steam from said secondary conduit along said longitudinal axis at a velocity of approximately 250 to 1,000 feet per second.

* * * * *